US005273177A

United States Patent [19]

Campbell

[11] Patent Number: 5,273,177

[45] Date of Patent: Dec. 28, 1993

[54] PRESS-TO-OPEN DISPENSING CLOSURE

[76] Inventor: Phillip J. Campbell, 221-205 Calibre Chase Dr., Raleigh, N.C. 27609

[21] Appl. No.: 916,465

[22] Filed: Jul. 20, 1992

[51] Int. Cl.[5] ..... B65D 47/08; B65D 51/18

[52] U.S. Cl. ..... 220/281; 220/254; 220/339; 215/235; 215/301; 222/498; 222/517

[58] Field of Search ..... 215/235, 301; 220/281, 220/254, 256, 259, 262, 305, 339; 222/498, 508, 517

[56] References Cited

U.S. PATENT DOCUMENTS

| | | | |
|---|---|---|---|
| 4,095,712 | 6/1978 | Perrella | 220/254 |
| 4,124,151 | 11/1978 | Hazard | 222/498 |
| 4,172,540 | 10/1979 | Erichson | 215/235 X |
| 4,223,814 | 9/1980 | Sneider | 222/565 |
| 4,413,742 | 11/1983 | Sandhaus | 215/216 |
| 4,487,342 | 2/1984 | Shy | 222/481.5 |
| 4,645,086 | 2/1987 | Rosenthal | 215/235 |
| 4,669,622 | 6/1987 | Bennett | 215/237 |
| 4,732,315 | 3/1988 | Gunn | 229/125.09 |
| 4,739,900 | 4/1988 | Borst | 220/339 |
| 4,750,669 | 6/1988 | Leight | 229/125.02 |
| 4,760,938 | 8/1988 | Wenger | 222/498 |
| 4,776,501 | 10/1988 | Ostrowsky | 222/517 |
| 4,901,892 | 2/1990 | Song | 222/498 |
| 4,911,337 | 3/1990 | Rosenthal | 222/498 |
| 5,022,566 | 6/1991 | Song et al. | 222/480 |
| 5,038,957 | 8/1991 | Gross | 220/335 |
| 5,065,911 | 11/1991 | Rohr et al. | 222/517 |

*Primary Examiner*—Allan N. Shoap
*Assistant Examiner*—Vanessa Caretto

[57] ABSTRACT

A press-to-open dispensing closure with a flexible arcual top surface(22) in convex orientation is provided which includes a flexible, aperture cover(26) having an arcuate hinging connection to the top surface. The hinging connection of the appeture cover articulates between a convexly arcuate closed condition and a concavely arcuate open position.

5 Claims, 6 Drawing Sheets

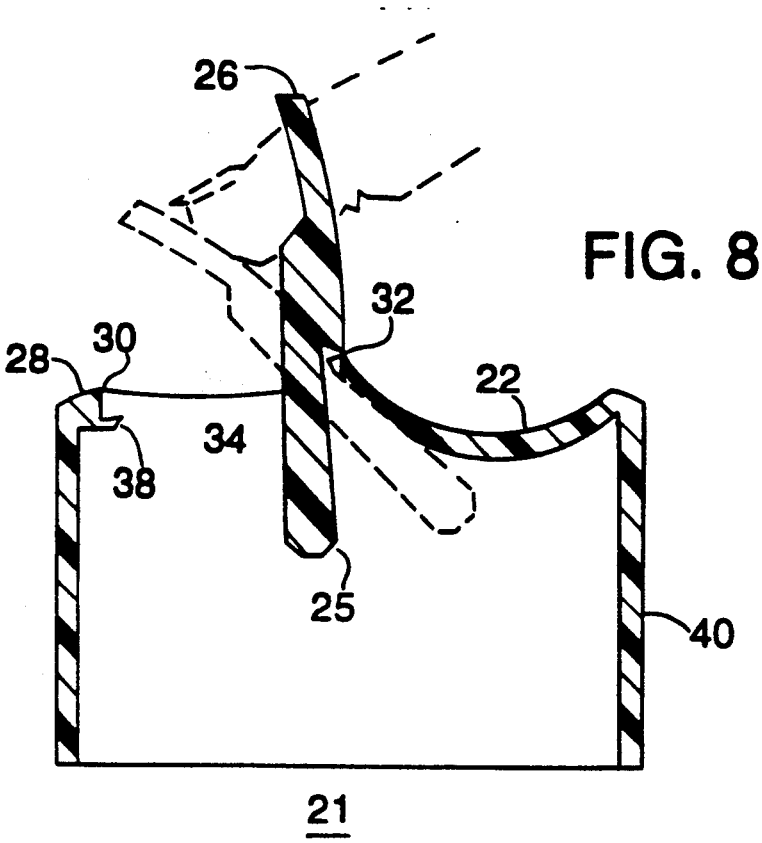
FIG. 8
FIG. 9
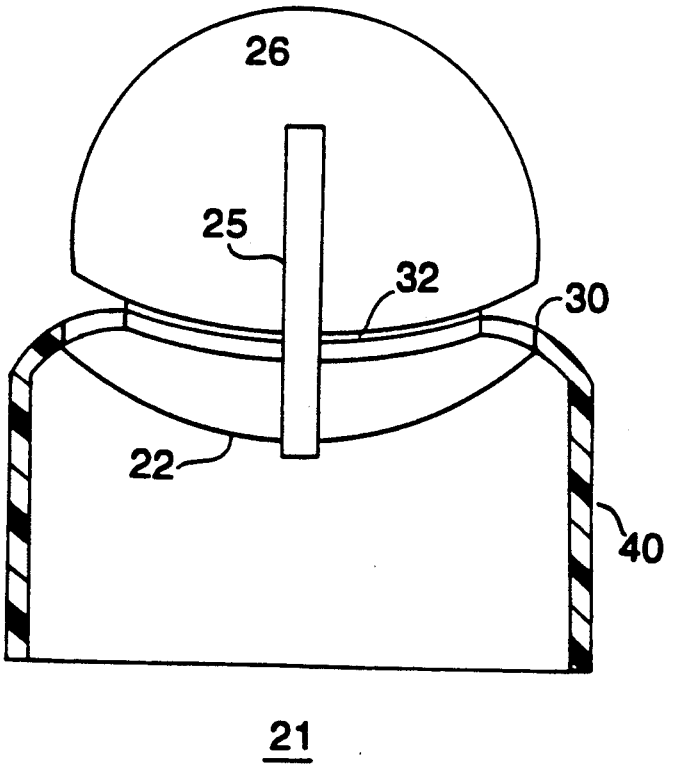

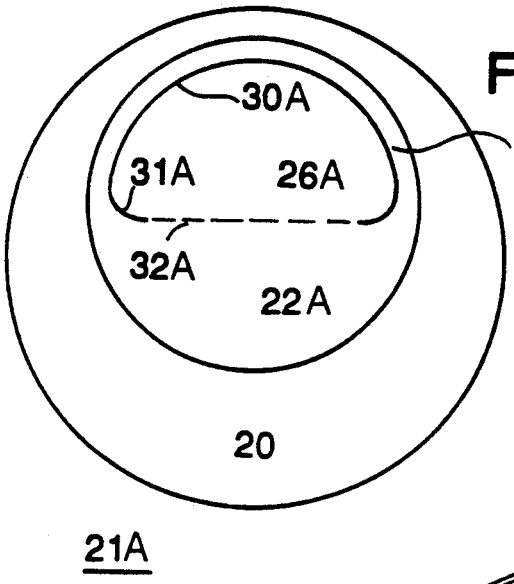
FIG. 10
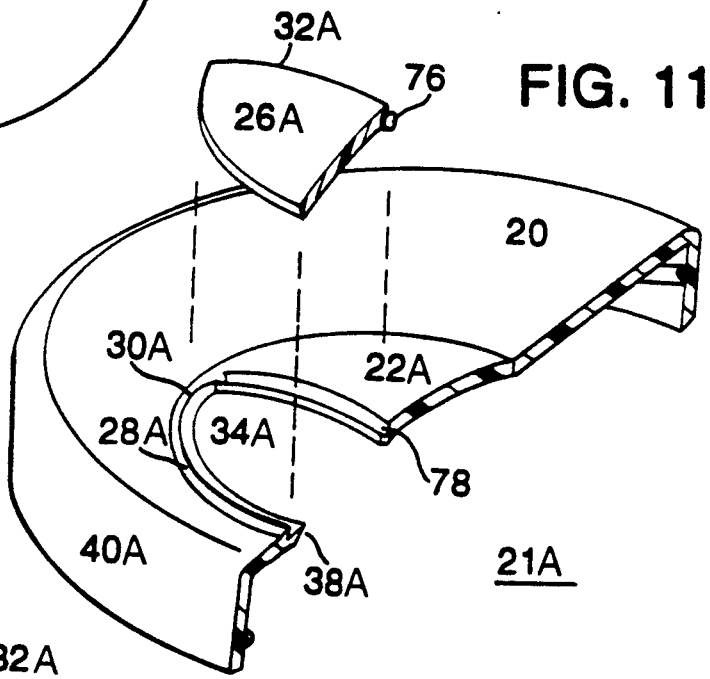
FIG. 11
FIG. 12
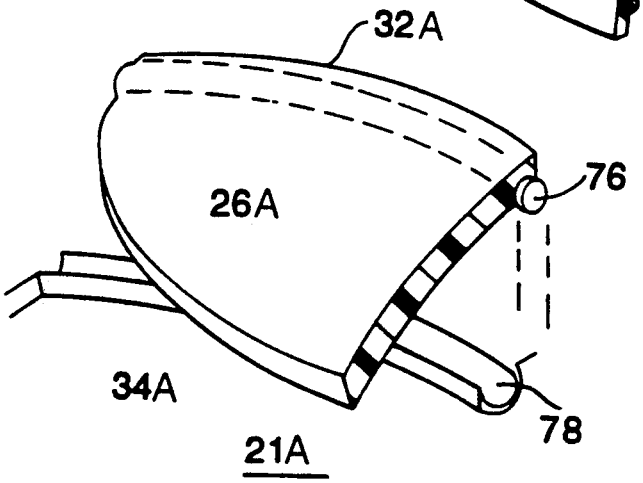

PRESS-TO-OPEN DISPENSING CLOSURE

BACKGROUND

1. Field of Invention

The present invention relates to dispensing closures for foods, liquids and other products.

2. Description of Prior Art

Dispensing closures have been in demand by consumers for many years. Typically, manufacturers have supplied the market with lids, fitments and caps that must be flipped open in some fashion to access the container's contents. As shown for example, in U.S. Pat. No. 4,516,689 which issued to Baker on Jun. 22, 1984 and shows a snap-in type of closure fitment that requires a pulling open and pushing to close type of action. This type of closure has been provided as a metal spout in cartons but can be difficult to open and can damage fingernails in the process.

U.S. Pat. No. 5,022,566 which issued to Song and Hofman on Jun. 11, 1991 shows a press-to-open side dispensing closure that can be actuated by pressing down on a portion of the lid that toggles. This closure is restricted to dry product dispensing and like others of its type does not provide a resilient force to hold the unit in the closed position. U.S. Pat. No. 4,776,501 issued to Ostrowsky on Oct. 11, 1988 shows a self closing press-to-open type of dispensing closure that also relys on a toggle action but closes automatically. This type of closure is restricted to liquid product and does not allow the advantage of leaving the container open for multiple usage in short intervals.

Most prior art dispensing closures tend to be difficult to open, rely on friction fitting to keep them closed and in most cases do not close all the way without final force supplied by the user. Also prior art shows that in most cases the closure must be manufactured in two or more pieces which can be costly. Despite all the prior art work in this field there still remain problems in the manufacture and operation of dispensing closures.

OBJECTS AND ADVANTAGES

Accordingly, it is the objective of the present invention to provide an improved dispensing closure that will alleviate the problems discussed above. It is another object of the invention to provide a dispensing closure that:

a. can be manufactured in one or more pieces, is inexpensive to make and is positive in actuation and reclosure.

b. can be utilized on a variety of containers for a variety of products and uses as a cap, lid, or fitment.

c. provides an improvement over existing dispensing closures and more particularly an improved press-to-open dispensing closure that incorporates a "push button" type of actuation and a built in spring like tension for a "snap back" reclosure action and resilient force to hold the closure in the closed position.

DESCRIPTION OF DRAWINGS

FIGS. 8 and 9 are orthographic side and front views respectively, of a dispensing closure of the type shown in FIG. 1 illustrating an optional lever to aid in reclosure;

FIG. 10 is an alternative embodiment of a dispensing closure in accordance with the present invention;

FIG. 11 is a perspective half sectional view of a dispensing closure of the type shown in FIG. 10 showing a two piece configuration;

FIG. 12 is a perspective half sectional detail view of a dispensing closure of the type shown in FIG. 10 illustrating a detail of a two piece configuration;

DESCRIPTION OF FIGS. 1 to 9

Figure 1:
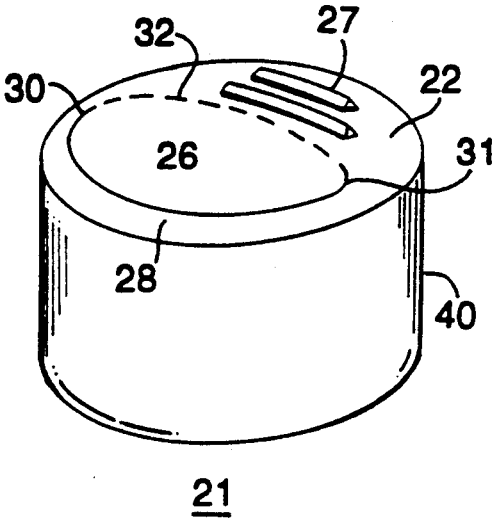
FIG. 1 is a perspective view of a dispensing closure in accordance with one embodiment of the present invention.

A typical embodiment of a closure of the present invention is illustrated in FIGS. I to 9. Referring to FIG. 1 a dispensing closure 21 is shown comprising a flexible partially spherical membrane 22 top surface that is surrounded by a downward projecting body portion 40 which is provided to surround and close the opening in a container to which it is secured. Partially spherical membrane 22 is in convex orientation, that is, with body 40 pointing downward. Body 40, and flexible partially spherical membrane 22 can be formed as one piece of material ranging in thickness from thin sheet stock to heavier gauge thickness by a variety of molding methods such as injection molding or vacuum forming.

The flexible partially spherical membrane 22 may also be formed separately, and snapped or glued into a body at a later time. The closure may be made out of plastics such as polyethylene or polypropylene but other materials such a plastic laminated paper will work also. Protrusions 27 or raised ridges acting as grips may be provided on the surface of partially spherical membrane 22 to help prevent slipping and to aid in tactile and visual recognition of the actuation press point during operation of the closure. A cut or line of separation 30 is provided through flexible membrane 22 that creates a partially detached flap herein referred to as flexible aperture cover 26. Part of the aperture cover remains attached to the partially spherical membrane and acts as a hinge. This attached portion of aperture cover 26 which is located at or near the half way point (or middle) of flexible partial sphere 22 will herein be referred to as arcuate hinge segment 32 indicated here by a dotted line.

Figure 2:
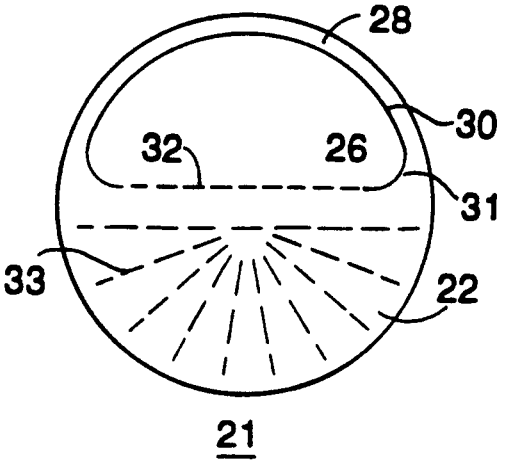
FIG. 2 is a top or plan view of a dispensing closure of the type shown in FIG. 1.
Figure 3:
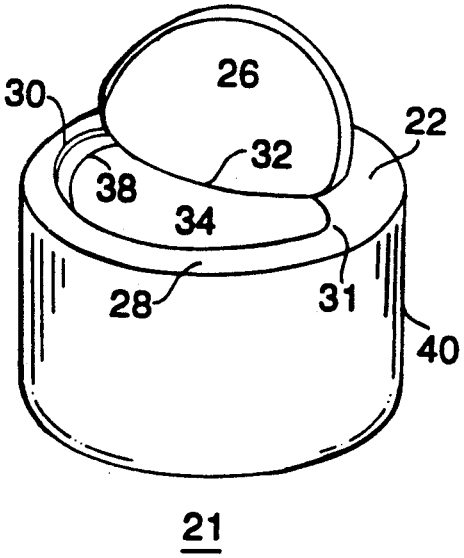
FIG. 3 is a perspective view of a dispensing closure of the type shown in FIG. 1 in the open position.
Figure 4:
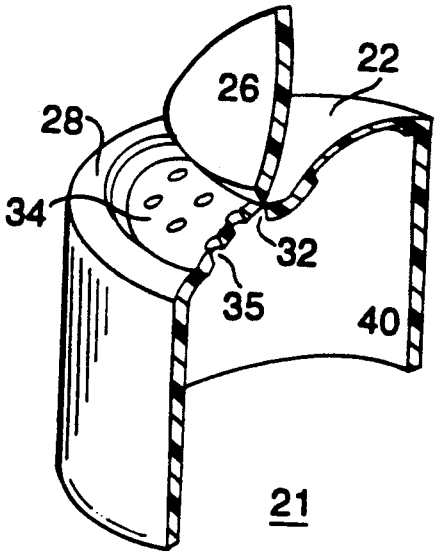
FIG. 4 is a perspective half sectional view of a dispensing closure of the type shown in FIG. 1 illustrating the open position, and a multiple orifice aperture.

Referring to FIG. 2 the line of separation 30 is shown conforming with the circumference of the partially spherical membrane 22 and terminating where arcuate hinge segment 32 begins. As illustrated, arcuate hinge segment 32 does not span the complete diameter of the partial sphere but falls short concentrically on both sides. In order for the line of separation 30 to terminate where arcuate hinge segment 32 begins, line of separation 30 must run up the sides of flexible partial sphere 22 at an angle (which may vary) for the remaining distance. This angled turn of line of separation 30 may be given a radius 31 to aid in the stress relief of the material at this point. A series of grooves 33 arranged in a radial or semi-circular pattern is provided on the underside of partially spherical membrane 22. Grooves 33 may be employed to aid in the reduction of the tensile resistance that is realized during articulation of the closure. Through the use of grooves 33 the flexibility of partially spherical membrane can be controlled or gauged. FIG. 3 shows the closure in the open position where there is provided an aperture 34 which passes through flexible membrane 22 and is revealed when aperture cover 26 is articulated upward. Also there is provided a curb 28 which is a continued portion of flexible partially spherical membrane 22 that aids in the stability of the membrane during articulation. A sealing lip 38 is provided as an extension of curb 28. Sealing lip 38 is a thin flexible element that is formed around and telescopes through aperture 34 when the closure is in the open position. In the closed position sealing lip 38 provides a compressive sealing shelf which conforms to the aperture cover 26 with resilient pressure. Referring to FIG. 4 an aperture 34 is provided that may have a plurality of configurations as well as a plurality of opening types as indicated here for instance as a series of small holes 35 for dispensing granular, powdered or crystaline product from shaker containers. A single hole , pin size or larger, may also be desirable for the dispensing of lotions, shampoos and the like.

Figure 5:
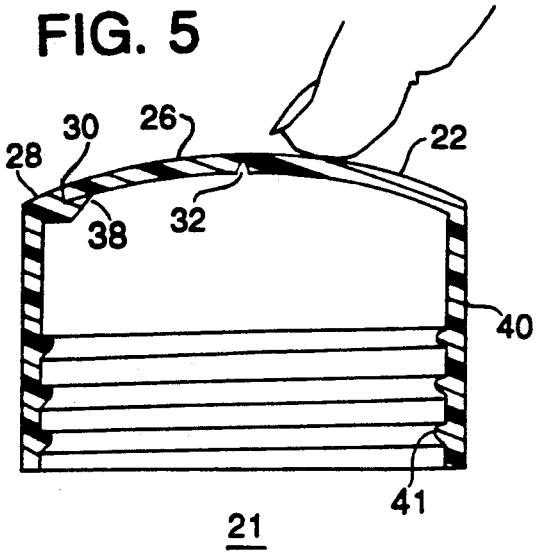
FIG. 5 is an orthographic sectional side view of a dispensing closure of the type shown in FIG. 1 in the closed position.

Referring to FIG. 5 the arcuate hinge segment 32 is provided as a thinned down, or scored section of the material on the undersurface of flexible partial sphere 22. This thinning or scoring of the material (often referred to as a living hinge)in this area enables the arcuate hinge segment 32 to flex a multitude of times without fatiguing or fracturing. Referring to FIGS. 8 and 9 a downward projecting member 25 may be provided as a lever to assist and aid in the reclosure of the device. FIG. 10-12 illustrates an alternative embodiment of the present invention designated generally therein by reference number 21A. The closure 21A is similar and functions in a similar manner to the first embodiment of the closure 21 described above with reference to FIG. 1-9. The elements of the second embodiment that are identical or functionally analogous to those of the first embodiment of the closure 21 are designated by identical reference numbers to those used for the first embodiment with the exception that the second embodiment reference numbers are followed by the upper case letter A. In the second embodiment closure 21A has a top 20 and a downward projecting body 40A with mating threads that allow for the attachment of the closure to containers with like mating threads. Also a flexible partially spherical membrane 22A is provided in convex orientation, that is with body 40A pointing downward at a position that is offset from the center of top 20.

Flexible partially spherical membrane 22A, as illustrated, has a smaller diameter than that of top 20. Referring to FIG. 11, FIG. 11 illustrates a flexible, convexly arcuate aperture cover 26A that is molded separately from closure 21A and having a cylindrical segment of material 76 running along the hinging edge of, and conforming to, its convexly arcuate shape. Located on flexible partially spherical membrane 22 A, at the hinging point of aperture cover 26A, there is provided a cylindrical groove 78 that corresponds to, and receives by snap fitting, the cylindrical segment of material 76. The two parts can now be brought together and assembled by snapping the cylindrical segment of material 76 into cylindrical groove 78. FIG. 12 shows an enlarged view of the above mentioned. This arrangement allows for the aperture cover 26A and the closure 21A to be made in different colors, thus offering a multitude of color combinations which may be desirable. This arrangement also illustrates that the closure can be made in a wide range of sizes. This embodiment, for example, could be employed on containers ranging from water pitchers to large trash cans.

Figure 13:
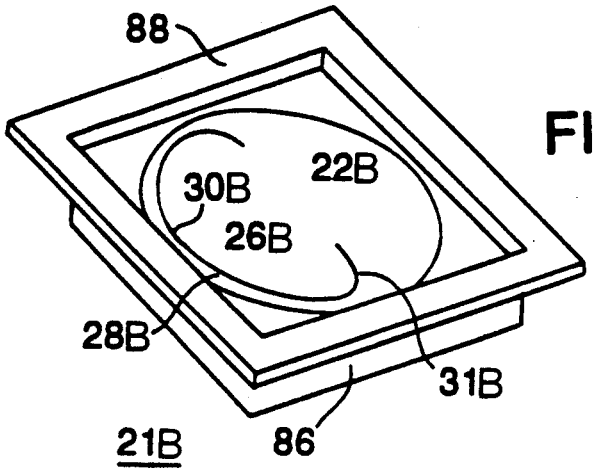
FIG. 13 is an alternative embodiment of a dispensing closure in accordance with the present invention.
Figure 14:
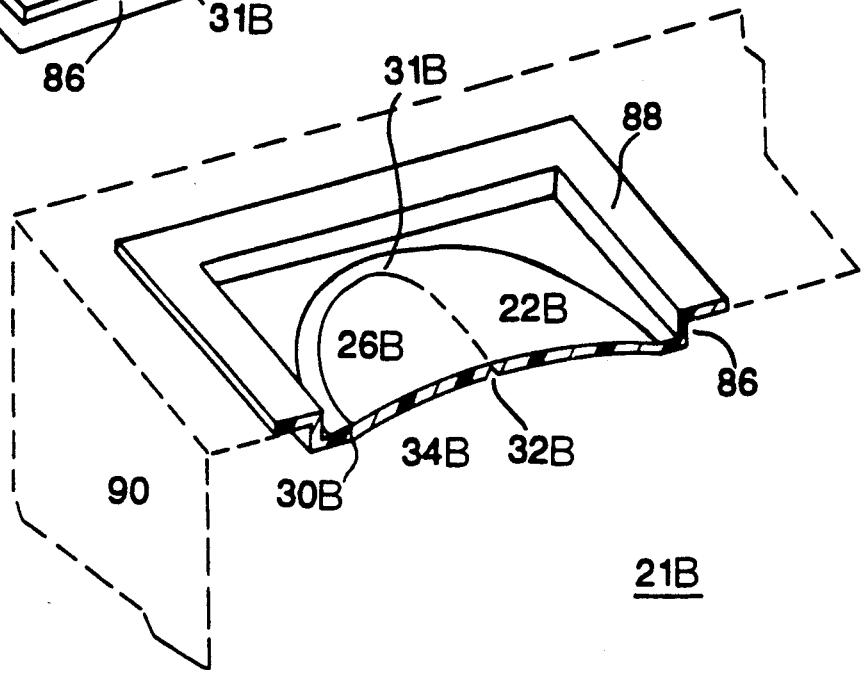
FIG. 14 is a perspective half sectional view of a dispensing closure of the type shown in FIG. 13.
Figure 15:
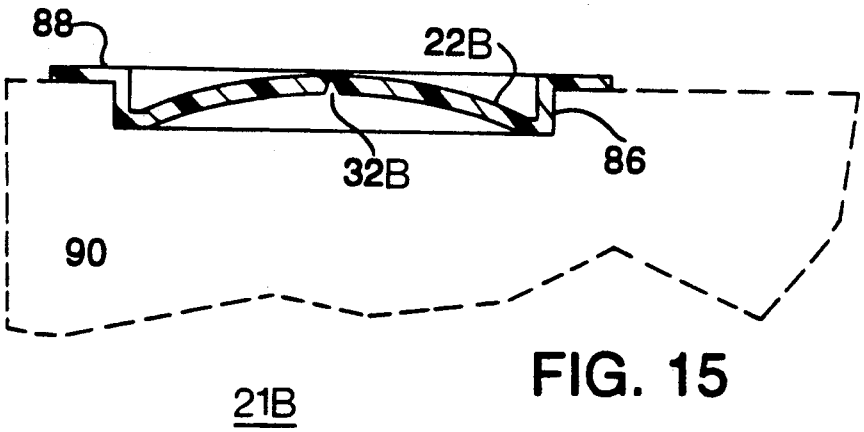
FIG. 15 is an orthographic half sectional side view of a dispensing closure of the type shown in FIG. 13.

FIG. 13-15 illustrates an alternative embodiment of the present invention designated generally therein by reference number 21B. The closure 21B is similar and functions in a similar manner to the first embodiment of the closure 21 described above with reference to FIGS. 1-9. The elements of the third embodiment that are identical or functionally analogous to those of the first embodiment of the closure 21 are designated by identical reference numbers to those used for the first embodiment with the exception that the third embodiment reference numbers are followed by the upper case letter B. Referring to FIG. 13, FIG. 13 shows dispensing closure 21B having a partially spherical membrane 22B, an aperture 34B, and aperture cover 26B formed inside a rectangular box 86 with extending flanges . FIG. 14 shows closure 21B as a fitment attached to a carton 90 designated here by dashed lines. Flanges 88 continuously surround rectangular box 86 in order to act as a stop and an area for adhesively bonding closure 21B to the carton 90. Closure 21B telescopes through an opening in the top or side of carton 90 until the flanges 88 prevent it from going further. FIG. 15 shows that flexible partially spherical membrane 22B is lower than, and/or is even with, the height of the plane of the flanges 88 respectively. Recessing of this element facilitates automated assembly, shipping and stackability of the cartons and aids in the prevention of accidental actuation of the closure.

Figure 16:
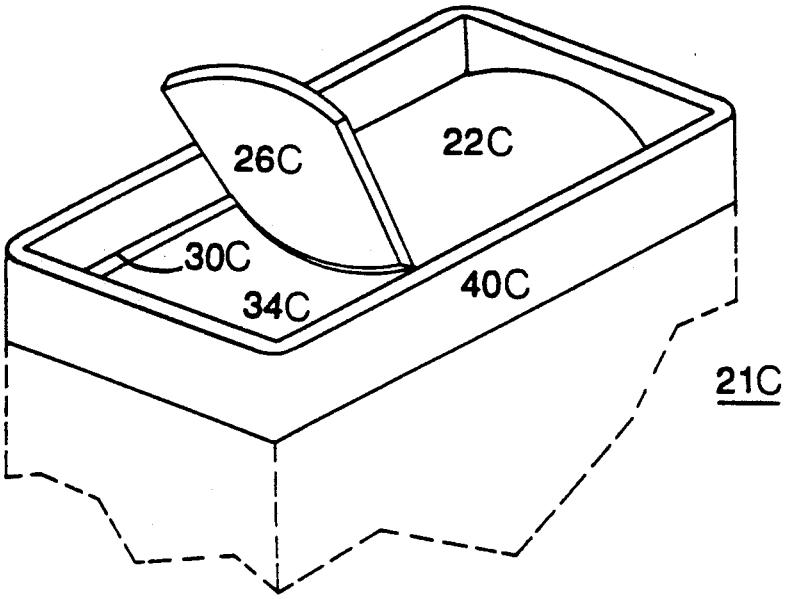
FIG. 16 is an alternative embodiment of a dispensing closure in accordance with the present invention.
Figure 17:
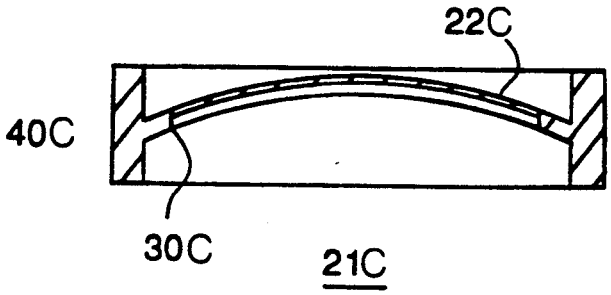
FIG. 17 is an orthographic end view of a dispensing closure of the type shown in FIG. 16.
Figure 18:
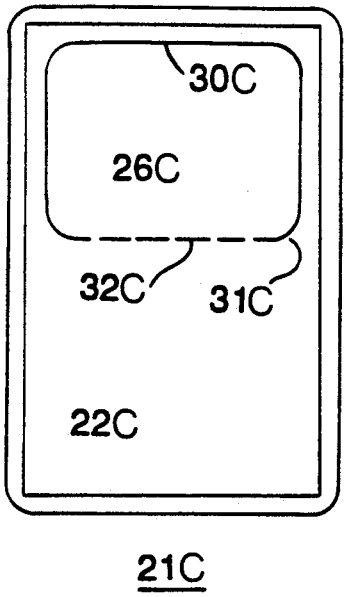
FIG. 18 is a plan view of a dispensing closure of the type shown in FIG. 16.

FIG. 16-18 illustrates an alternative embodiment of the present invention designated generally therein by reference number 21C. The closure 21C is similar and functions in a similar manner to the first embodiment of the closure 21 described above with reference to FIG. 1-9. The elements of the fourth embodiment that are identical or functionally analogous to those of the first embodiment of the closure 21 are designated by identical reference numbers to those used for the first embodiment with the exception that the fourth embodiment reference numbers are followed by the upper case letter C. Referring to FIG. 16, FIG. 16 shows a dispensing closure 21C with a flexible partially cylindrical membrane 22C in rectangular shape surrounded by a downward projecting body 40C that is designed to enable the closure to be attached to a container. Flexible partially cylindrical membrane 22C is in a convexly arcuate orientation to body 40C.

A line of separation 30C cuts through top membrane 22C and creates a partially attached flap that will herein be designated as aperture cover 26C. The remaining attached segment of aperture cover 26C is thinned or scored on the underside of flexible membrane 22C and acts as a hinge section herein referred to as arcuate hinge 32C. FIG. 17 shows flexible membrane 22C at a location that is lower than the top of body portion 40C. This configuration aids in stackability of containers and helps prevent accidental actuation of the closure. FIG. 18 shows the offset location of aperture cover 26C that provides room for an actuation press point opposite the aperture. In this configuration the closure may be employed on rectangular containers in rectangular configuration which in some applications may be desirable.

OPERATION

Figure 6:
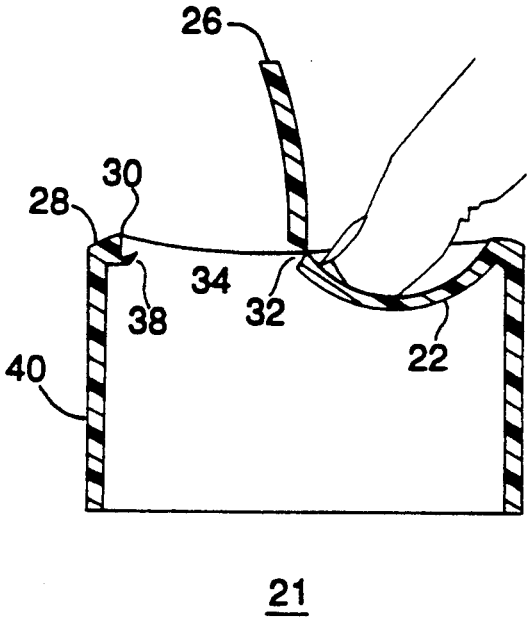
FIG. 6 is an orthographic sectional side view of a dispensing closure of the type shown in FIG. 1 illustrating articulation.
Figure 7:
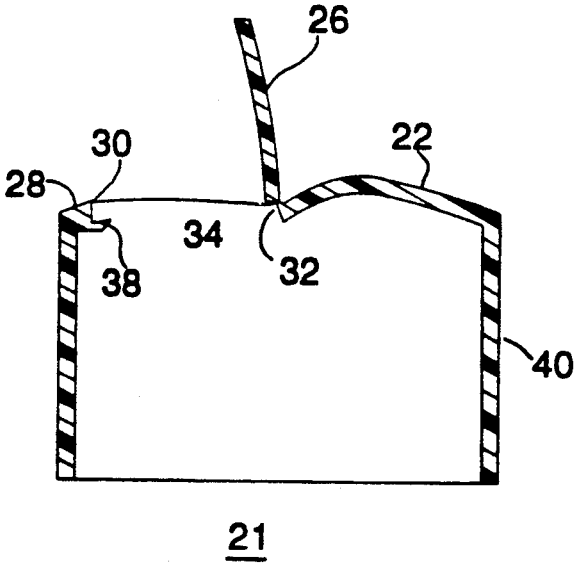
FIG. 7 is an orthographic side view of a dispensing closure of the type shown in FIG. 1 illustrating the open position.

Actuation of the closure may be best illustrated with reference to FIGS. 5 to 9. Referring to FIG. 5 this view shows closure 21 in the closed condition. Sealing lip 38 is shown in a compressed condition resiliently pushing up against aperture cover 26 but with a force that is substantially less than that exerted by aperture cover 26 in the closed position. FIG. 6 shows that downward force applied to flexible partially spherical membrane 22, in the closed position, at a point opposite that of aperture cover 26 causes the flexible membrane to deform in a downward fashion carrying with it arcuate hinge segment 32. This downward movement causes flexible partially spherical membrane 22 and arcuate hinge segment 32 to pass a point of resistance in convex condition and to become exposed to the pulling force of their respective concave conditions thus pulling downward, then driving upward, aperture cover 26 to a locked or cocked-open position with a "snap-like" effect. FIG. 7 shows that upon removal of the downward force, flexible partially spherical membrane 22 snaps back to an incomplete convex condition where it remains slightly deformed at the hinge segment. Arcuate hinge segment 32, however, retains the concavely arcuate disposition thereby holding the aperture cover 26 in the upright or open position. At this point product may be dispensed from the container to which the closure is attached.

To close the dispensing closure, a pushing force applied to the aperture cover 26 in the direction of the aperture 34 creates a leveraged force that causes concavely arcuate hinge segment 32 to pass a point of resistance in concave condition and to become exposed to the pulling force of its opposite convex condition. At this point the aperture cover 26 snaps down over the aperture 34 with a spring like positive "pop" and is resiliently held in the closed position by the convexly arcuate condition of arcuate hinge 32 and convexly arcuate partially spherical membrane 22.

Referring to FIG. 8 lever 25 is shown as an extension of aperture cover 26 pointing downward in the open position. Dotted lines show the path of aperture cover 26 during reclosure and illustrates that lever 25 comes in contact, with and pushes upward, concavely arcuate partially spherical membrane 22 thus assisting in the reclosure of the device.

SUMMARY, RAMIFICATIONS, AND SCOPE

Accordingly, the reader will see that the dispensing closure of the present invention can be used on a variety of containers for a variety of products as a cap, lid, or fitment. In addition the present invention allows for operation of the closure without the use of a pulling-up or flipping open motion. Furthermore, this invention has additional advantages in that

- it allows the closure to be made as a one-piece device;
- it allows the closure to be made in two pieces so a variety of colors may be employed;
- it provides a closure that maintains a resilient force to hold it in the open and closed positions;
- it provides for easy opening and reclosure;
- it allows for one-hand operation;
- it provides a built-in spring like force to aid in positive actuation and reclosure.

While the present invention has been described with respect to certain preferred embodiments, it is easily observed that variations and modifications may be introduced without departing from the true spirit and scope of this invention.

What is claimed is:

1. An improved closure for a container having a mouth opening therein comprising: a body portion surround the mouth opening of said container, said body portion having an inverted bowl-shaped, convex top wall, said top wall having an aperture therein communicating with the interior of said container, a flexible, arcuate top surface adjacent said aperture, said arcuate top surface being alternately movable between convex and concave positions, and a flexible arcuate aperture cover connected to said top surface adjacent said aperture by an arcuate hinge line, said aperture cover being in a closed position when said top surface is in said convex position, and said aperture cover pivoting about said hinge line to an open position when said top surface is moved to said concave position.

2. The closure of claim 1, further including a compressive shelf of material encircling said aperture to receive said flexible arcuate aperture cover to act as a stop.

3. The closure of claim 1 wherein said arcuate hinge line is a integral thinned down length of said flexible arcuate top surface material.

4. The closure of claim 1, wherin said closure is made as one piece of material.

5. The closure of claim 1, wherin said closure is made of polypropylene.

* * * * *